US009914579B2

(12) United States Patent
Smith et al.

(10) Patent No.: US 9,914,579 B2
(45) Date of Patent: Mar. 13, 2018

(54) DUAL COMPONENT MIXING BAG

(71) Applicants: Ronald Keith Smith, Saginaw, MI (US); Matthew Scott Peterson, Herriman, UT (US)

(72) Inventors: Ronald Keith Smith, Saginaw, MI (US); Matthew Scott Peterson, Herriman, UT (US)

(73) Assignees: Source 1 Environmental, Davison, MI (US); Reddog U.S.A., Inc., West Valley, UT (US)

( * ) Notice: Subject to any disclaimer, the term of this patent is extended or adjusted under 35 U.S.C. 154(b) by 753 days.

(21) Appl. No.: 14/085,014

(22) Filed: Nov. 20, 2013

(65) Prior Publication Data

US 2014/0140166 A1 May 22, 2014

Related U.S. Application Data

(60) Provisional application No. 61/728,303, filed on Nov. 20, 2012.

(51) Int. Cl.
*B65D 81/32* (2006.01)
*B65D 75/56* (2006.01)
*B65D 33/16* (2006.01)

(52) U.S. Cl.
CPC ..... *B65D 81/3266* (2013.01); *B65D 33/1666* (2013.01); *B65D 75/56* (2013.01)

(58) Field of Classification Search
CPC .... B65D 81/3266; B65D 33/1666; A61J 1/10; A61J 1/12; A61J 1/2034; A61J 1/2093
USPC ..... 383/9
See application file for complete search history.

(56) References Cited

U.S. PATENT DOCUMENTS

| | | | | |
|---|---|---|---|---|
| 3,149,943 | A | 9/1964 | Amador | |
| 4,312,352 | A * | 1/1982 | Meisch | A61G 7/0503 604/322 |
| 4,588,154 | A | 5/1986 | Basore | |
| 5,257,985 | A * | 11/1993 | Puhl | A61J 1/2093 206/221 |
| 5,749,657 | A * | 5/1998 | May | B65D 33/14 383/17 |
| 2002/0138066 | A1* | 9/2002 | Manica | A61J 1/2093 604/410 |
| 2007/0157424 | A1* | 7/2007 | Mottahedeh | A01G 1/125 15/405 |

(Continued)

*Primary Examiner* — Tony G Soohoo
*Assistant Examiner* — Elizabeth Insler
(74) *Attorney, Agent, or Firm* — Dickinson Wright PLLC

(57) ABSTRACT

A container has elastomeric sheets defining a periphery with four sides. A seal extends about the periphery defining a closed chamber. A separator extends across the closed chamber dividing the closed chamber into a first compartment and a second compartment. The separator includes a rod for wrapping the sheets around the rod to define a dividing portion. A retainer clip presents an inner wall clamped about the dividing portion providing an impermeable closure between the sheets. The sheets define at least two aligned and spaced pockets separated by a gap whereby removing the rod from the retainer clip and inserting the rod into the pockets extending across the gap and clamping the retainer clip over the rod to define a handle. The present invention also includes a method for mixing a first component and a second component in the container and releasing the components.

4 Claims, 3 Drawing Sheets

(56) References Cited

U.S. PATENT DOCUMENTS

2012/0102890 A1* 5/2012 Fily ..... A45C 13/14
53/469

* cited by examiner

DUAL COMPONENT MIXING BAG

CROSS REFERENCE TO RELATED APPLICATION

This application claims the benefit of a provisional application Ser. No. 61/728,303 filed on Nov. 20, 2012 entitled "Dual Component Mixing Bag," the entire disclosure of the application being considered part of the disclosure of this application, and hereby incorporated by reference.

BACKGROUND OF THE INVENTION

1. Field of the Invention

An assembly for carrying, containing and mixing a first component and a second component and a method for mixing the first component and the second component.

2. Description of the Prior Art

U.S. Pat. No. 3,149,943 discloses a refrigerant package including a bag and a divider disposed transversely to the bag and separating the bag into two compartments for containing two different chemicals. The divider includes a rod and a clip. The clip is disposed over the rod for sandwiching the bag to the rod to provide a seal. However, the '943 patent fails to provide for a clip having improved sealing properties while also providing for a bag permitting use of a handle for carrying the bag.

U.S. Pat. No. 4,588,154 discloses a hamper bag frame having side panels defining channels extending between side panels and a rod inserted between the side panels to create a handle. However, the '154 patent fails to disclose a divider for dividing a sealed container sealed with use of a rod.

SUMMARY OF THE INVENTION

The invention provides for an assembly for carrying, containing, and mixing a first component and a second component. A container includes at least one sheet material with a seal extending about the container to form a closed chamber. A separator extends across the closed chamber and includes a rod disposed on the sheet material. The sheet material is wrapped over the rod to provide a dividing portion between a first compartment having the first component and a second compartment having the second component. The separator may also include a clip disposed thereon to assist in forming a seal between the first and second compartments. After mixing the first and second components, the rod is inserted into pockets formed in the sheet material permitting the container to be manually carried with use of the rod as a handle.

A second aspect of the invention is a method including the steps of inserting the rod in the aligned and spaced pockets and across the gap to provide a handle for manually carrying the container.

Advantages of the Invention

The invention in its broadest aspect includes an assembly that provides for using the separator of the assembly to construct a handle therefore allowing the container to be easily carried after mixing the first component and a second component in the container.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
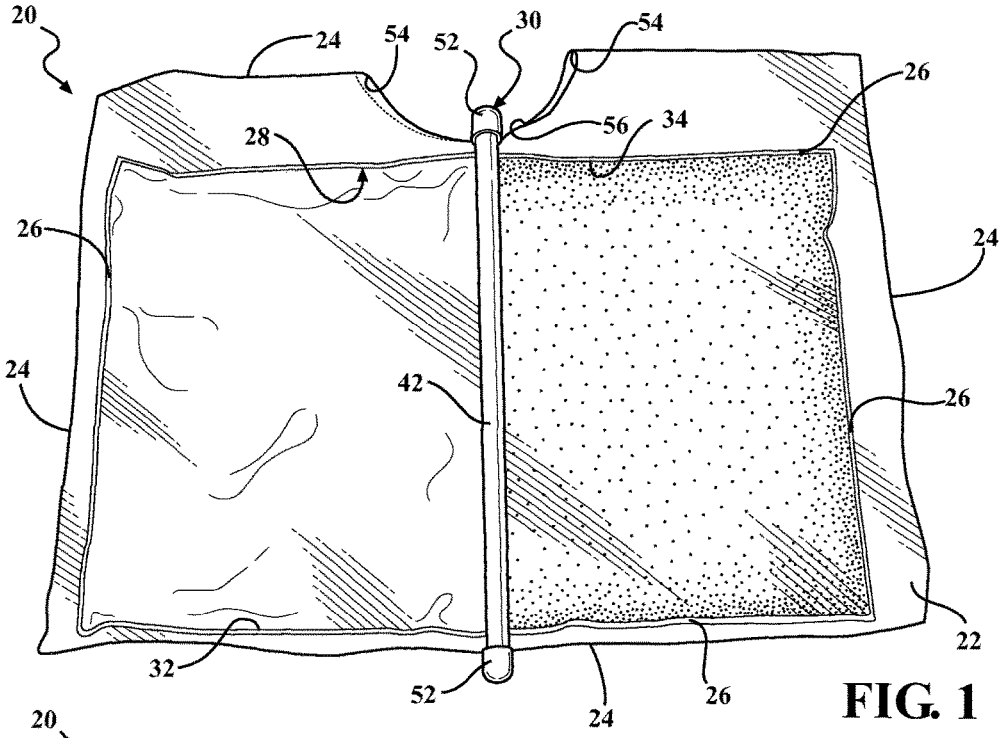
FIG. 1 is a front view of the container of the present invention.
Figure 2:
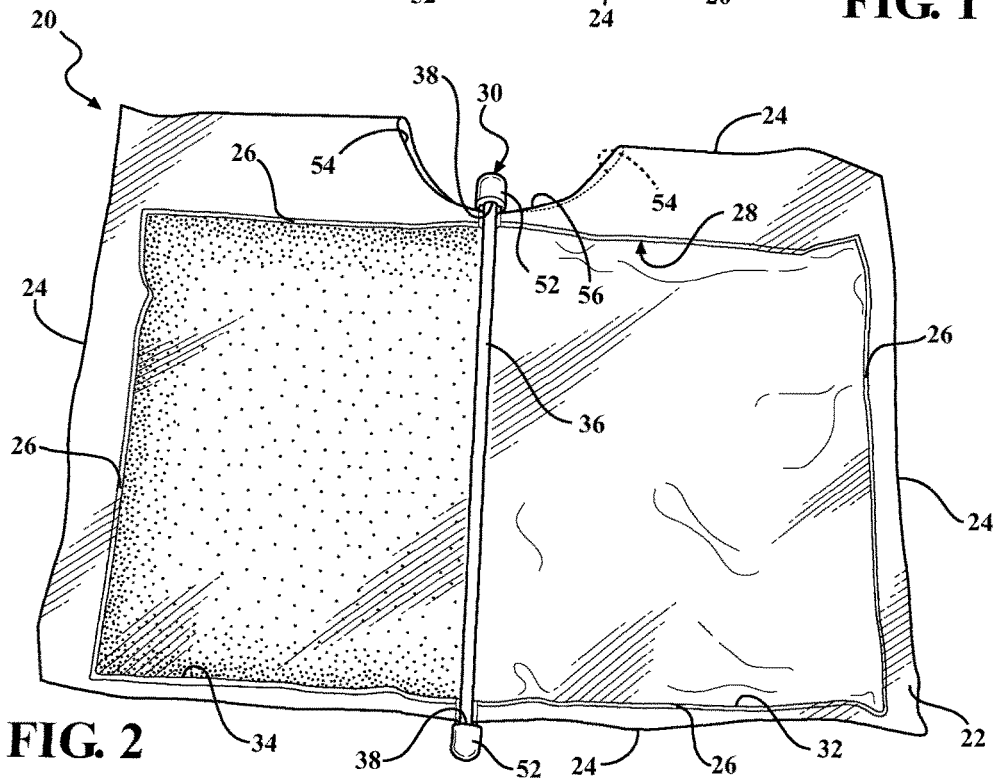
FIG. 2 is a back view of the container of the present invention.

Referring to the Figures, wherein like numerals indicate corresponding parts throughout the several views, an assembly for containing and mixing a first component and a second component is constructed in accordance with the subject invention is generally shown in the Figures.

The assembly includes a container 20, as generally indicated, having a plurality of elastomeric sheets 22 of impermeable material including a first sheet and a second sheet disposed in a sandwiched relationship to one another and defining a periphery 24 with four sides. Although the use of two sheets is described, it should be appreciated that one sheet made be used, provided it was folded upon itself to form two sides. The container 20 includes a seal 26 extending about the periphery and joining the elastomeric sheets 22 together to perfect a barrier impervious to liquid and defining a closed chamber 28. Alternatively, the elastomeric sheets 22 may be made of liquid permeable materials for containing solid materials or any other material having the requisite physical characteristics.

A separator 30 extends across the closed chamber 28 between two of the sides dividing the closed chamber 28 into a first compartment 32 for containing a first component and a second compartment 34 for containing a second component. The separator 30 includes a rod 36 disposed on the first sheet of the container 20 and extending transversely between distal ends 38. The rod 36 is disposed respectively over the seal 26 and beyond the closed chamber 28 for wrapping both of the elastomeric sheets 22 of the container 20 around the rod 36 to define a dividing portion 40. The dividing portion 40 separates the first compartment 32 and the second compartment 34.

Figure 3:
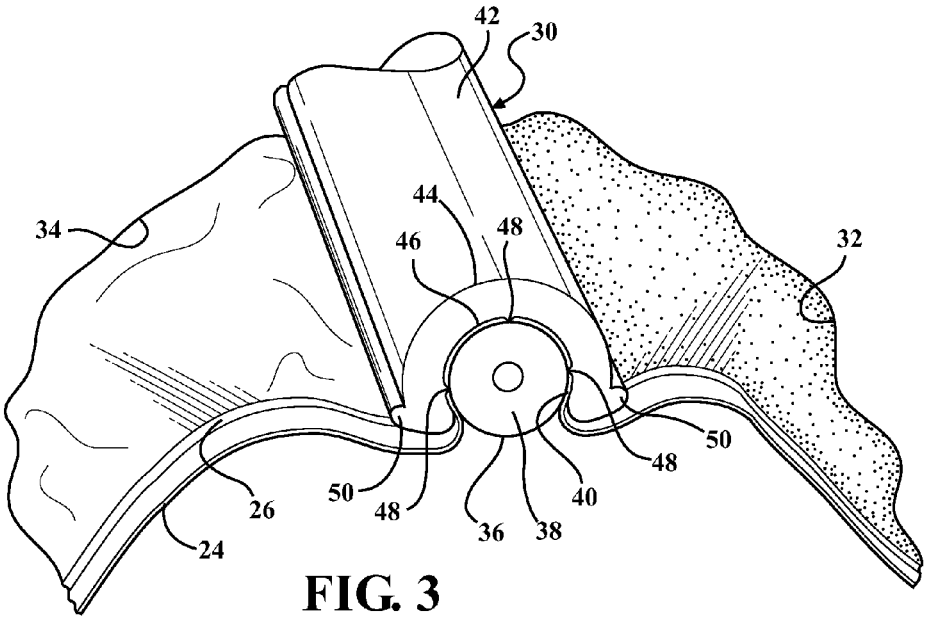
FIG. 3 is a fragmentary end view of the separator of the assembly of the present invention.

The separator 30 includes a retainer clip 42 extending longitudinally between the distal ends 38 and having a C-shape cross-section, as best shown in FIG. 3. Alternatively, the retainer clip 42 may have a different cross-sectional shape. For example, but not limited to, U-shape or V-shape. The retainer clip 42 extending circumferentially between first and second edges and including an outer wall 44 and an inner wall 46 is clamped about the dividing portion 40 and the rod 36. This configuration provides an impermeable closure between the elastomeric sheets 22 in the dividing portion 40 for separating the first compartment 32 and the second compartment 34. In other words, the dividing portion 40 of the elastomeric sheets 22 is sandwiched between the rod 36 and the retainer clip 42 to provide the impermeable boundary separating the first compartment 32 and the second compartment 34.

As shown in FIG. 3, a plurality of ribs 48 extend outwardly from the inner wall 46 of the retainer clip 42 and longitudinally, at least in part, between the distal ends 38 for engaging the dividing portion 40 to perfect the impermeable boundary. A lip 50 extends radially outwardly from the outer wall 44 of the retainer clip 42 and along each of the first and second edges for permitting manually opening and removing the retainer clip 42 from the rod 36. An end cap 52 having a cup shape is disposed over the retainer clip 42 and the distal ends 38 for providing a cover at each of the distal ends 38.

Figure 4:
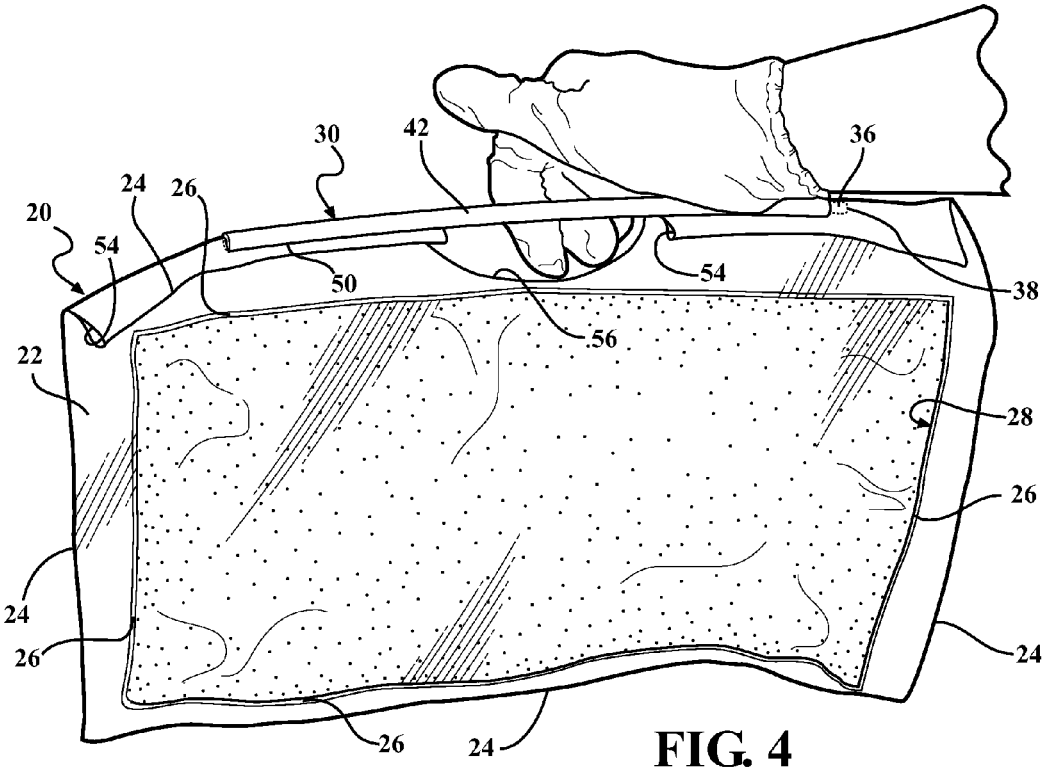
FIG. 4 is a front view of the container of the present invention including a handle created by using the retainer clip and the rod.
Figure 5:
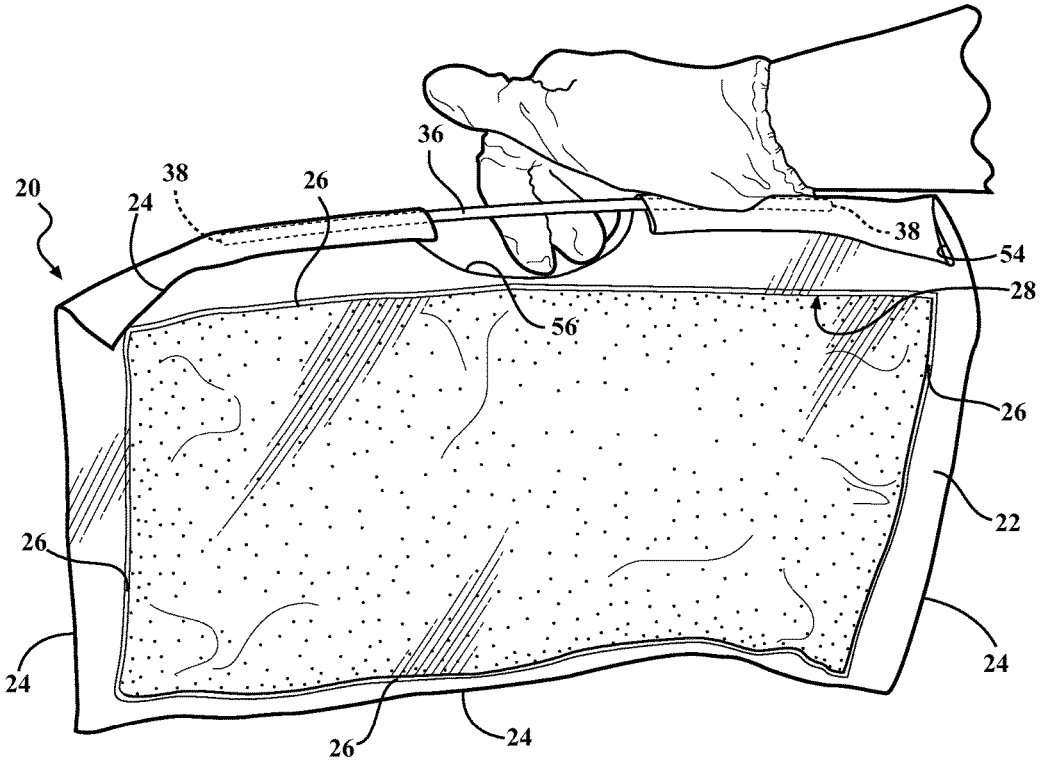
FIG. 5 is a front view of the container of the present invention including a handle created by using the rod.

The elastomeric sheets 22 extend in parallel from the seal 26 along one of the four sides to define at least two aligned and spaced pockets 54 separated by a gap 56. The gap 56 extends outwardly and upwardly from the adjacent distal end 38 of the rod 36 in an arcuate shape. The rod 36 is removed from the retainer clip 42 and inserted into the pockets 54 to extend across the gap 56 and clamping the retainer clip 42 over the rod 36 to secure the rod 36 in the pocket 54 creating a handle, as best shown in FIG. 4. In other words, after the removal of the separator 30, the rod 36 is inserted through the pockets 54 extending across the gap 56 and the retainer is clamped over the rod 36 for securing the rod 36 in the pockets 54 to create the handle for allowing an individual to carry the container 20. Alternatively, as shown in FIG. 5, instead of using both the retainer clip 42 and the rod 36 to create the handle, the handle can be created by inserting the rod 36 of the separator 30 into the pockets 54 extending across the gap 56.

Although the foregoing description provides for use of the rod 36 as a handle, it should be appreciated that although the rod 36 and retainer clip 42 are used as the separator between the first and second compartments, other items may also be used as the handle including, without limitation, an elongated flat-like stick such as a paint mixing stick.

The present invention also includes a method for mixing the first component and the second component in the container 20 wherein the steps of the method may be performed in a sequence other than the order recited.

For example, the method includes a first step of removing the retainer clip 42 from the rod 36, followed by removing the rod 36 from the sheets and releasing the dividing portion 40 to open the compartments 32, 34 to one another. The method then proceeds with mixing the component in the first compartment 32 with the component in the second compartment 34. The step of mixing the first compartment 32 and the second compartment 34 may be further defined as agitating the container 20 for allowing the first component in the first compartment 32 to thoroughly mix with the second component in the second compartment 34. It should be appreciated that various techniques may be used to provide the mixing, among these include crumpling, shaking or in any way physically agitating the container 20.

Another step of the method is inserting the rod 36 and the retainer clip 42 in the aligned and spaced pockets 54 and across the gap to provide a handle for manually carrying the container 20. Alternatively, only the rod 36 may be inserted in the aligned and spaced pockets 54 to provide the handle. Additionally, the rod 36 may be first inserted in the aligned and spaced pockets 54 and the retainer clip 42 may be clamped about the rod 36 and the aligned and spaced pockets 54 to provide the handle.

Another step of the method is to release the mixed components from the container 20. The step of releasing the mixed components may be further defined as providing an opening to the container 20 for allowing the mixed components to flow outside of the container 20. It should be appreciated that various techniques could be used to provide the opening to the container 20, among these include cutting or piercing the container 20 with an object to create an opening.

Obviously, many modifications and variations of the present invention are possible in light of the above teachings and may be practiced otherwise than as specifically described while within the scope of the appended claims.

What is claimed is:

1. An assembly for carrying, containing, and mixing a first component and a second component, comprising:

a container including at least one sheet having a seal of rectangular shape and having four sides extending about said container and defining a closed chamber;

a separator extending across two of said four sides of said seal and said closed chamber dividing said closed chamber into a first compartment for containing the first component and a second compartment for containing the second component;

said separator including a rod disposed on said at least one sheet of said container and extending transversely between distal ends disposed respectively over said seal for wrapping said at least one sheet of said container around said rod to define a dividing portion separating said first compartment containing the first component and said second compartment containing the second component;

said separator including a retainer clip extending longitudinally between said distal ends and extending circumferentially between first and second edges and including an outer wall and presenting an inner wall with said inner wall clamped about said dividing portion; and said sheet extending from said seal to define at least two coaxially aligned pockets disposed in tandem and spaced from one another and extending parallel along one of said four sides of said seal perpendicular to said separator and defining a gap between said pockets for receiving said rod such that said rod extends across said gap and said retainer clip being secured to said rod sandwiching said sheet between said rod and said retainer clip to define a handle for carrying and containing a mixed component consisting of the first component and the second component, and wherein said gap defines a space to allow an individual's hand to engage the handle to carry said container containing the mixed component.

2. An assembly as set forth in claim 1 wherein said gap has an arcuate shape and extends outwardly and upwardly from said adjacent distal end of said rod.

3. The assembly of claim 1, wherein said retainer clip is disposed around said rod to clamp and to secure said rod into said pockets to define the handle.

4. An assembly for carrying, containing, and mixing a first component and a second component, comprising:

a container including a plurality of elastomeric sheets of impermeable material having a first sheet and a second sheet disposed in a sandwiched relationship to one another and defining a periphery with four sides;

said container including a seal extending about said periphery and joining said elastomeric sheets together to perfect a barrier impervious to liquid and defining a closed chamber;

said elastomeric sheets extending in parallel from said seal along one of said four sides to define at least two coaxially aligned pockets disposed in tandem and spaced from one another and extending parallel along one of said four sides of said seal defining a gap extending between said pockets;

a separator including a rod and a retainer clip for receiving said rod;

said separator having a pre-mixing configuration and a post-mixing configuration associated with said container;

wherein the pre-mixing configuration includes:

said separator extending across said closed chamber between two of said four sides and perpendicular to said pockets dividing said closed chamber into a first compartment for containing the first component and a second component for container the second component;

said rod being disposed on said first sheet of said container and extending transversely between distal ends disposed respectively over said seal and beyond said closed chamber for wrapping both of said elastomeric sheets of said container around said rod to define a dividing portion separating said first compartment and said second compartment, said retainer clip extending longitudinally between said distal ends and having a generally C-shape cross-section presenting an outer wall extending circumferentially between first and second edges and an inner wall with said inner wall clamped about said dividing portion and said separator to provide an impermeable closure between said elastomeric sheets in said dividing portion for separating said first compartment and said second compartment, a plurality of ribs extending outwardly from said inner wall of said retainer clip and longitudinally between said distal ends for engaging said dividing portion to perfect said impermeable closure, a lip extending radially outwardly from said outer wall of said retainer clip and along each of said first and second edges for manually opening and removing said retainer clip from said rod, an end cap of generally cup shape disposed over said retainer clip and said distal ends for providing cover at each of said distal ends, and said gap extending adjacent said distal end of said rod; and wherein the post-mixing configuration includes:

said rod being received by said pockets and extending across said gap, and said retainer clip being disposed over said rod sandwiching said elastomeric sheets between said rod and said retainer clip to clamp and to secure said rod in said pockets to define a handle for carrying and containing a mixed component consisting of the first component and the second component, and wherein said gap defines a space to allow an individual's hand to engage the handle to carry said container containing the mixed component.

* * * * *